US009024220B2

(12) United States Patent
Birkholz et al.

(10) Patent No.: US 9,024,220 B2
(45) Date of Patent: May 5, 2015

(54) DRIVE MECHANISM FOR ELECTRIC SWITCHING DEVICES HAVING THREE SEPARATE POSITIONS

(75) Inventors: Martin Birkholz, Berlin (DE); Sebastian Goeschel, Schoenwalde (DE); Andreas Kleinschmidt, Oranienburg (DE)

(73) Assignee: Siemens Aktiengesellschaft, Munich (DE)

( * ) Notice: Subject to any disclaimer, the term of this patent is extended or adjusted under 35 U.S.C. 154(b) by 244 days.

(21) Appl. No.: 13/377,243

(22) PCT Filed: May 18, 2010

(86) PCT No.: PCT/EP2010/056801

§ 371 (c)(1),
(2), (4) Date: Dec. 9, 2011

(87) PCT Pub. No.: WO2010/142515

PCT Pub. Date: Dec. 16, 2010

(65) Prior Publication Data

US 2012/0085633 A1 Apr. 12, 2012

(30) Foreign Application Priority Data

Jun. 9, 2009 (DE) ..... 10 2009 024 938

(51) Int. Cl.

| | |
|---|---|
| ***H01H 3/40*** | (2006.01) |
| ***H01H 33/42*** | (2006.01) |
| *H01H 31/00* | (2006.01) |
| *H01H 33/02* | (2006.01) |

(52) U.S. Cl.

CPC ..... *H01H 33/42* (2013.01); *H01H 31/003* (2013.01); *H01H 33/022* (2013.01)

(58) Field of Classification Search

CPC ..... H01H 3/40; H01H 31/02; H01H 31/28; H01H 31/32; H01H 3/00; H01H 19/00; H01H 1/00; H01H 15/06

USPC ..... 200/501, 48 R, 19.01, 19.05, 19.07, 200/19.18, 502, 253.1, 572; 218/154; 74/640, 10.8, 332, 352, 421 A, 606 R

See application file for complete search history.

(56) References Cited

U.S. PATENT DOCUMENTS 3,780,625 A * 12/1973 Weston et al. ..... 91/418
4,250,476 A * 2/1981 Evans et al. ..... 335/17

(Continued)

FOREIGN PATENT DOCUMENTS

CH 528 162 9/1972
CN 101436486 A 5/2009

(Continued)

*Primary Examiner* — Edwin A. Leon
*Assistant Examiner* — Anthony R. Jimenez
(74) *Attorney, Agent, or Firm* — Laurence A. Greenberg; Werner H. Stemer; Ralph E. Locher

(57) ABSTRACT

A switching device assembly has an encapsulation housing. Movable active conductors are located inside the encapsulation housing. A drive unit with a gearbox is located outside of the encapsulation housing. The gearbox is part of a kinematic chain for moving an active conductor. The kinematic chain penetrates the encapsulation housing. In order to reverse the direction of a movement of the gearbox that can be transmitted, the gearbox is turned around a reversing axis and coupled into the kinematic chain.

16 Claims, 4 Drawing Sheets

(56) References Cited

U.S. PATENT DOCUMENTS

| | | | | |
|---|---|---|---|---|
| 5,180,051 | A * | 1/1993 | Cook et al. | 200/400 |
| 7,589,289 | B2 * | 9/2009 | Yu | 200/48 R |
| 7,790,997 | B2 | 9/2010 | Girodet et al. | |
| 2006/0105880 | A1 * | 5/2006 | Gacond et al. | 476/27 |
| 2007/0261946 | A1 | 11/2007 | Yu | |
| 2008/0257703 | A1 * | 10/2008 | Jonsson et al. | 200/48 R |

FOREIGN PATENT DOCUMENTS

| | | | |
|---|---|---|---|
| DE | 37 01 216 | A1 | 7/1988 |
| DE | 298 06 654 | U1 | 6/1998 |
| DE | 198 25 386 | A1 | 12/1999 |
| DE | 103 54 594 | A1 | 6/2005 |
| JP | 2002517151 | A | 6/2002 |
| WO | 2005050688 | A | 6/2005 |

* cited by examiner

DRIVE MECHANISM FOR ELECTRIC SWITCHING DEVICES HAVING THREE SEPARATE POSITIONS

BACKGROUND OF THE INVENTION

Field of the Invention

The invention relates to a switching device arrangement having a movable active conductor which is arranged within an encapsulating housing and a drive device which is arranged outside the encapsulating housing and has a gear mechanism as part of a kinematic chain for moving the active conductor, the kinematic chain passing through the encapsulating housing.

Such a switching device arrangement is known, for example, from the utility model DE 298 06 654 U1. Said document describes a gas-insulated high-voltage switchgear assembly which has a switch disconnector and an associated drive device. The drive device therein has a first and a second right-parallelepipedal region, with the result that a shoulder is formed on the drive device. Drive devices with such a design can be arranged in free spaces of the gas-insulated high-voltage switchgear assembly which have small dimensions, wherein a plurality of mutually overlapping drive devices enables an effective use of space.

Independently of the position of the drive device, the mode of operation and thus the output movement direction thereof remain the same.

In different positions, however, provision may also be made for movements to be generated by a drive device to act in different directions. Until now, it has been necessary for such applications for there to be two versions of drive devices.

Retaining two versions of drive devices involves warehousing complexity.

BRIEF SUMMARY OF THE INVENTION

The object of the invention is therefore to specify a switching device arrangement having a drive device which can output drive forces in different movement directions in a simple manner.

According to the invention, the object is achieved in the case of a switching device arrangement of the type mentioned at the outset by virtue of the fact that the gear mechanism is coupled into the kinematic chain in such a way as to be turned alternately about a turning axis so as to reverse the direction of a movement which can be output.

An encapsulating housing is, for example, a fluid-tight encapsulating housing as is used in high-voltage switchgear assemblies. Fluid-tight encapsulating housings are in the form of cast housings or welded housings, for example, with the interior of the encapsulating housings having been filled with a fluid, for example an insulating gas or an insulating liquid. Active conductors or active conductor runs are preferably arranged, with the fluid flowing around them, within an encapsulating housing, said active conductors or active conductor runs serving to conduct an electrical current and having electrical potentials applied thereto for this purpose which are different, for example, than the potential of the encapsulating housing. Movable active conductors are used if necessary for producing an isolating distance, a connection to ground or the like. The movable active conductors can also be used for producing a connection between an active conductor run and ground potential, in addition to forming an isolating point in an active conductor run. It has proven to be particularly advantageous to use a combination of a plurality of movable active conductors which can be moved by a common drive device, wherein a first active conductor is used for producing an isolating point within an active conductor run and a second active conductor is used for connecting an active conductor run to ground potential.

Advantageously, the first and second active conductors can be driven by one and the same drive device.

A drive device is advantageously arranged outside the encapsulating housing and has a gear mechanism. The gear mechanism is part of a kinematic chain which serves to transfer a movement from a source, for example an electric motor drive, a handheld drive or the like to a movable active conductor. The kinematic chain passes through the encapsulating housing for this purpose. In the event of a fluid-tight configuration of the encapsulating housing, the kinematic chain should enable fluid-tight transfer of a movement through the encapsulating housing.

Upon actuation of two movable active conductors by the same drive device, a neutral position is advantageous in which the two movable active conductors are electrically insulated from the encapsulating housing and an isolating point is formed in an active conductor run. From this neutral position, it is possible by means of the drive device to move the first active conductor into a switch-on position and thus to bridge the isolating point in the active conductor run. For this purpose, the drive device produces a movement in a first direction. In order to reset the first active conductor to the neutral position, there is a reversal of the direction of movement into a second direction until the neutral position is reached. In order to drive the second movable active conductor, there is an output of a movement of the drive device in the second direction and, in order to move the second movable active conductor back and to bring said movable active conductor into the neutral position, there is a movement in the first direction.

The sense of direction of the first movement and second movement are directed opposite to one another. The first direction and the second direction each need to be defined depending on the design conditions of the active conductors in the interior of the encapsulating housing.

If a change is now made to the arrangement of the active conductors in the interior, a reversal of the sense of direction of the first and second direction is possibly required for moving the first and second active element.

In order to avoid changes to the encapsulating housing, the drive device advantageously needs to be adapted correspondingly for this purpose. Reversing the direction results in the gear mechanism being turned about a turning axis.

A rotation about the turning axis results in a change in the sense of direction of the movements output by the gear mechanism. It is thus possible to retain the drive device per se in terms of its design and to modify the drive device merely in respect of the position of the gear mechanism which is used for transmitting a movement onto a movable active conductor in the interior of the encapsulating housing. For this purpose, the gear mechanism is constructed as a type of cartridge which fixes the individual gear mechanism elements with respect to one another and enables the gear mechanism to turn without any problems. It is thus possible to couple the gear mechanism in the two turned positions into the kinematic chain and thus to enable a reversal of direction on one and the same encapsulating housing. In this case, the movement paths of the gear mechanism remain the same independently of the position thereof. In respect of the first direction and the second direction, the sense of direction thereof is swapped over. The drive device has an electric motor drive which is connected at a fixed angle to the gear mechanism. The electrical driving of the gear mechanism remains the same independently of the position of said gear mechanism since a change in the sense of direction is achieved as a result of the gear mechanism being turned. The electric motor drive is turned jointly with the gear mechanism.

An advantageous configuration can in this case provide for the kinematic chain to have a shaft which passes through the encapsulating housing, and the turning axis to be aligned radially with respect to the shaft.

A shaft serves to transfer a rotary movement. Rotary movements need to be transferred through the encapsulating housing in such a way as to be sealed off in a simple manner by corresponding sealing rings. Owing to a rotation, favorable sealing is made possible in the peripheral region of the shaft. Furthermore, when the turning axis is aligned radially with respect to the axis of the shaft, there is the possibility of maintaining a vertical alignment of the gear mechanism and the shaft in the different installed positions of the gear mechanism.

Furthermore, provision can be made for the encapsulating housing to have an accommodating shaft, into which the gear mechanism is inserted in such a way as to be rotated alternately through 180° about the turning axis.

By virtue of the accommodating shaft on the encapsulating housing, it is possible to fix the gear mechanism relative to the encapsulating housing. Owing to the position of the shaft, which passes through the encapsulating housing, the accommodating shaft is suitable for maintaining the vertical alignment of the shaft and the gear mechanism with respect to one another. Furthermore, in the case of a cartridge-like configuration of the gear mechanism, a rotary movement of the gear mechanism about the turning axis through 180° makes it possible for said gear mechanism to be positioned within the accommodating shaft and in the process to use one and the same accommodating points for the fixed-angle fixing of the gear mechanism within the accommodating shaft in different installed positions. It is therefore possible to maintain the radial alignment of the shaft and the turning axis. Advantageously, the shaft should pass through the encapsulating housing within the accommodating shaft. When using intermeshing toothed gears on the gear mechanism, at least one toothed gear axis, preferably a plurality of toothed gear axes, in particular all of the toothed gear axes should be positioned parallel to the turning axis. Movement axes of moving parts of the gear mechanism should preferably be positioned vertically or parallel to the turning axis in a projection.

Advantageously, the gear mechanism should have toothed gears with toothed gears which are toothed at the end, wherein the axes of rotation of the toothed gears are preferably aligned parallel to the turning axis. A rotary movement of one of the toothed gears is converted into a lateral movement via a thrust crank and this lateral movement is transferred to a movable toothed rack. The lateral movement should run in a projection perpendicular to the turning axis. Such an arrangement makes it possible, for example, to couple a rotary movement produced by an electric motor into the gear mechanism and to output a lateral movement. There is also the possibility of using further shafts of the gear mechanism to feed in further drive forces or couple out movements. Provision can thus be made, for example, for it to be possible for a movement to be fed into the gear mechanism by means of a manually operable drive element, for example a crank.

Furthermore, provision can advantageously be made for the accommodating shaft to be delimited by a peripheral sealing face, which surrounds the drive device.

Delimiting the accommodating shaft by means of an intrinsically peripheral sealing face makes it possible to close the accommodating shaft, with it being possible to produce a sealing effect at the sealing face. It is thus possible for the drive device itself to be designed so as to be free of housings or protective devices. This makes it possible to keep the volume in particular of the gear mechanism low and for said gear mechanism to be covered by a hood, which rests in sealing fashion on the sealing face. This makes it possible to protect the drive device from the effect of foreign bodies in the interior of the accommodating shaft.

Advantageously, provision can furthermore be made for the accommodating shaft to have bearing points, and the gear mechanism to be fixed by means of at least one adaptor plate at the bearing points.

Arranging bearing points within the accommodating shaft makes it possible to position the drive device within the accommodating shaft relative to the peripheral sealing face or to the shaft. This makes it possible to provide for simple installation of the drive device in order to be able to couple the gear mechanism into the kinematic chain in a simple manner.

In this case, the bearing points should advantageously be used both for one position of the gear mechanism and for the other position of the gear mechanism. This makes it possible to ensure that installation errors are ruled out and the respectively desired definition of the sense of direction with respect to the first direction and the second direction is maintained.

In order to ensure good accessibility independently of the position of the gear mechanism in the interior of the accommodating shaft, provision can be made for the gear mechanism to be connected to the bearing points by means of at least one adaptor plate.

Furthermore, provision can advantageously be made for the shaft to have a toothed portion, via which a movement of the gear mechanism is coupled in.

A toothed portion on the shaft makes it possible to couple high actuating forces into the shaft and in the process to fix a definite position of the individual moving parts of the gear mechanism with respect to the shaft as a result of the toothed portion. This definitely assigned position is still maintained even after a large number of movement runs.

Advantageously, provision can be made for the toothed portion to be a toothed portion of a spur gear.

The toothed portion of a spur gear can be formed integrally on the shaft in a simple manner. The gear mechanism can be coupled to an end-side toothed portion from different radial directions. This provides a suitable configuration which enables the use of a drive with a flat construction which can also be arranged in confined conditions. Furthermore, an end-side toothed portion is particularly suitable for aligning a turning axis of the gear mechanism in the radial direction with respect to the shaft and enabling the gear mechanism to be coupled in radially.

Advantageously, provision can be made for the gear mechanism to have a laterally movable toothed rack, which is in indirect or direct engagement with the toothed portion of the shaft.

A laterally movable toothed rack can represent the output drive element of the gear mechanism. A lateral movement of a toothed rack can also be performed in slot-like cutouts in a switching device arrangement and in the process transfer high actuating forces.

The movable toothed rack can be in indirect or direct engagement with the toothed portion of the shaft.

In this case, provision can advantageously be made for the toothed rack to be in engagement with the shaft via a toothed gear which is mounted independently of the gear mechanism.

The use of a toothed gear mounted independently of the gear mechanism for transferring the movement of the toothed rack onto the shaft means that it is possible to additionally step down the movement of the toothed rack. Furthermore, by virtue of offsetting the toothed gear laterally with respect to the turning axis, the depth of the drive device can be reduced. It is thus possible firstly for the laterally movable toothed rack to be moved closer in the direction of the shaft and secondly for the movement or the forces to be applied to be stepped down correspondingly via the toothed gear which is mounted independently of the gear mechanism. The independent mounting of the toothed gear makes it possible to couple the actuating forces which can be transferred from the gear mechanism in onto different switching device arrangements and to match the movements output by the gear mechanism to the movements required on the shaft.

Furthermore, provision can advantageously be made for the toothed gear to abut the encapsulating housing when the position of the gear mechanism changes in mirror-inverted fashion with respect to the turning axis.

In the neutral position of the gear mechanism, the laterally movable toothed rack should be aligned as centrally as possible with respect to the turning axis. It is thus possible for the laterally movable toothed rack to be able to perform approximately identical excursions both in the first and in the second direction as the gear mechanism turns. In the case of an asymmetrical arrangement of the toothed rack with respect to the turning axis, it is now possible for the asymmetry of the position of the movable toothed rack to be compensated for via the change in the position of the toothed gear. In this case, the contact between the toothed gear and the toothed rack should be provided as centrally as possible on the toothed rack, with the result that it is possible for a movement to be output identically both in the first and in the second direction. In the case of a rotation of the gear mechanism about the turning axis, the asymmetrical position of the movable toothed rack with respect to the turning axis is compensated for by the mirror-inverted arrangement of the toothed gear and an approximately central contact between the toothed gear and the toothed rack on the toothed rack is made possible.

Advantageously, provision can be made for a switching position indicator device to be arranged on either side of the turning axis spaced apart from the turning axis.

Switching position indicator devices can advantageously be arranged on both sides of the turning axis, with the result that it is possible for the switching position devices to be driven in the same way independently of the arrangement of the gear mechanism. Starting from the gear mechanism, movements are coupled out for the purpose of driving the switching position indicator devices, said movements being transferred into the switching position indicator. It is thus possible for a respective switching position to be indicated directly using mechanical means. The switching position indicator devices can furthermore be provided with imaging contacts, with the result that electrical signaling of the switching position is also made possible.

An exemplary embodiment of the invention will be shown schematically in the figures and described in more detail below.

In the figures:

DESCRIPTION OF THE INVENTION

Figure 1:
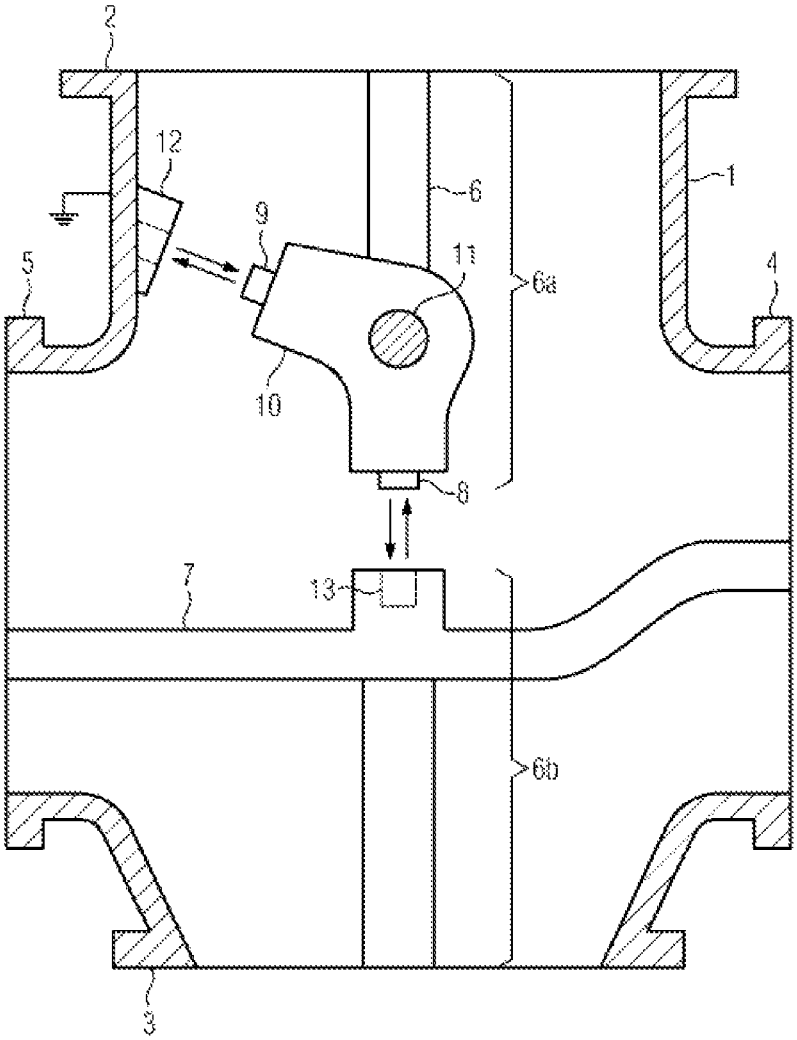
FIG. 1 shows a section through a switching device arrangement with movable active conductors.

FIG. 1 shows a section through an encapsulating housing 1. In the present case, the encapsulating housing 1 is in the form of a cast aluminum housing, wherein the encapsulating housing 1 has a first flange 2, a second flange 3, a third flange 4 and a fourth flange 5. The flanges 2, 3, 4, 5 are each in the form of annular flanges, wherein in each case two flanges are aligned coaxially with respect to one another and are arranged at opposite ends of the encapsulating housing 1. Thus, the first and second flanges 2, 3 are aligned coaxially with respect to one another and the third and fourth flanges 4, 5 are aligned coaxially with respect to one another. Coaxial axes of the first and second and third and fourth flanges 2, 3, 4, 5 are in this case aligned with respect to one another in such a way that they intersect one another. Preferably, the coaxial axes should in this case intersect one another at a right angle, with the result that the encapsulating housing is in the form of a so-called cross module. Connecting tubes which adjoin the flanges 2, 3, 4, 5 and merge with one another extend in the direction of the point of intersection of the coaxial axes. The encapsulating housing 1 thus forms an accommodating area in its interior. The flanges 2, 3, 4, 5 can be closed by fluid-tight disk insulators, for example, with the result that the interior of the encapsulating housing 1 can be filled with an electrically insulating fluid. Such a fluid is, for example, an electrically insulating gas, such as sulfur hexafluoride, nitrogen or another electrically insulating gas. Preferably, the fluid should be arranged in the interior of the encapsulating housing 1 under an elevated pressure.

A first active conductor run 6 and a second active conductor run 7 pass through the encapsulating housing 1. The first active conductor run 6 extends in the direction of the coaxial axis of the first and second flange 2, 3. The second active conductor run 7 extends in the direction of the coaxial axis of the third and fourth flange 4, 5. The first and second active conductor runs 6, 7 are in electrically conductive contact with one another, with the result that all of the conductor runs 6, 7 passing through the respective flanges 2, 3, 4, 5 can have the same electrical potential. The active conductor runs 6, 7 are mounted in such a way as to be electrically insulated with respect to the encapsulating housing 1 (for example via disk insulators closing the flanges 2, 3, 4, 5). A first movable active conductor 8 is arranged in the first active conductor run 6. The first active conductor 8 is part of the first active conductor run 6 and makes it possible to form an isolating point over the course of the first active conductor run 6. The first active conductor run can be divided in a first section 6*a* and a second section 6*b* via the isolating distance which can be produced by the first movable active conductor 8. For this purpose, the first active conductor 8 is capable of moving relative to the second active conductor run 7 and to the first and second sections 6*a*, 6*b*. Furthermore, a second movable active conductor 9 is provided. The second movable active conductor 9 is connected in DC-isolated fashion to the first active conductor run 6 and is capable of moving relative to the first active conductor run 6.

In addition to the first and second active conductor runs 6, 7 and first active conductors and second active conductors 8, 9 shown in FIG. 1, further active conductor runs and further movable active conductors can also be positioned within the encapsulating housing 1. These can have a configuration similar to that of the active conductor runs and active conductors shown in the figure, for example, and can be arranged one behind the other with respect to the plane of the drawing, for example. The encapsulating housing 1 with the active conductor runs 6, 7 and the active conductors 8, 9 represents a switching device arrangement.

The second active conductor run 7 is permanently connected in DC-isolated fashion and therefore electrically conductively to the second section 6*b* of the first active conductor run 6. A deflecting housing 10 acting as a dielectric barrier is arranged on the first section 6*a* of the first active conductor run 6. The deflecting housing 10 is manufactured from an electrically conductive material, for example, and is configured so as to be connected in DC-isolated fashion to the first active conductor run 6. An accommodating area is provided in the interior of the deflecting housing in order to be able to accommodate, at least partially, the first and second active conductors 8, 9. A movement of the two active conductors 8, 9 can in this case be provided in such a way that it is only possible for the second active conductor 9 to move out of the deflecting housing 10 when the first active conductor 8 has been withdrawn into the deflecting housing 10 or, conversely, a movement of the first active conductor 8 out of the deflecting housing 10 is only possible when the second active conductor 9 has been withdrawn into the deflecting housing 10. In order to couple in a movement, an electrically insulating shaft 11 is mounted on the deflecting housing 10. The shaft 11 is mounted rotatably and is used for coupling in a rotary movement in the interior of the deflecting housing 10 onto the movable active conductors 8, 9. A deflecting gear mechanism is arranged within the accommodating area of the deflecting housing 10.

The first movable active conductor 8 serves to produce an isolating distance between the first and second sections 6*a*, 6*b* of the first active conductor run 6. The second movable active conductor 9 serves to make electrical contact between the first section 6*a* of the first active conductor run 6 and the potential of the encapsulating housing 1. The encapsulating housing 1 generally conducts ground potential.

A mating contact 12 is integrally formed on encapsulating housing 1, with it being possible for the second movable active conductor 9 to be moved into said mating contact. In order to make electrical contact between the two sections 6*a*, 6*b* of the first active conductor run 6, a mating contact 13 for the first active conductor 8 is arranged in the second section 6*b* of the first active conductor run 6. The mating contacts 12, 13 are each in the form of bushes, whereas the movable active conductors 8, 9 are in the form of pins.

Figure 2:
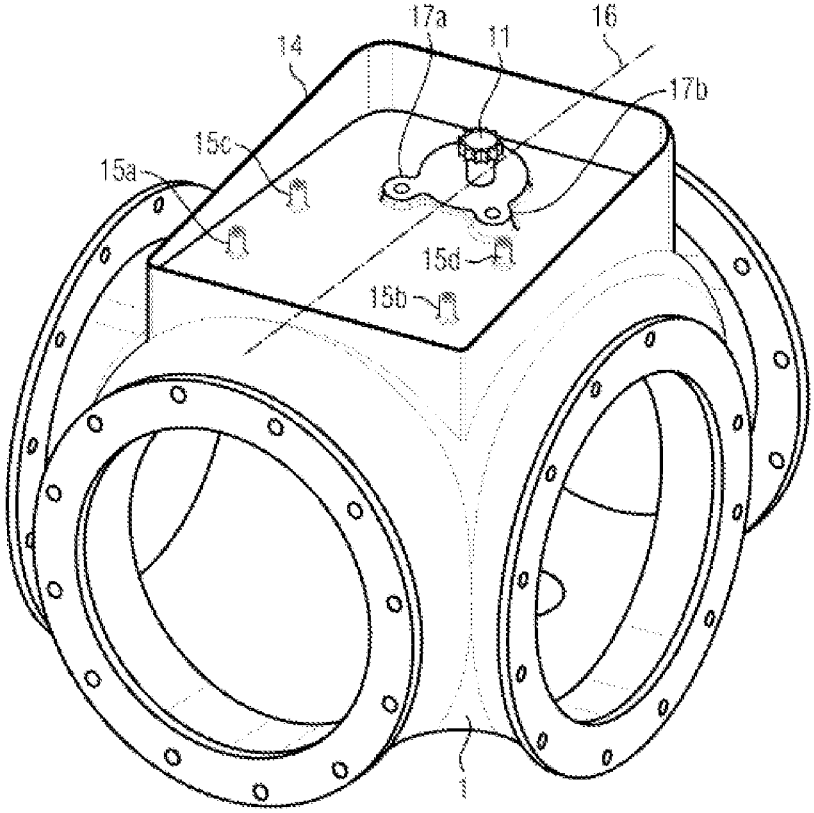
FIG. 2 shows a perspective view of the switching device arrangement known from FIG. 1.

The shaft 11 is dimensioned such that it passes through the encapsulating housing 1 at least at one point. FIG. 2 shows a perspective illustration of the encapsulating housing 1. The shaft 11 passes through a wall of the encapsulating housing 1. For this purpose, the shaft 11 is inserted into a fluid-tight bearing and sealed. The point at which the shaft 11 passes through the encapsulating housing 1 is surrounded by a sealing face 14. The sealing face 14 runs peripherally in intrinsically closed fashion and, in the present case, has a substantially rectangular contour, with the corners of the rectangular contour being rounded off. The sealing face 14 is arranged, for example, on an elevation on an outer surface of the encapsulating housing 1. In the present case, this elevation is shaped so as to drop away in the form of a wedge, wherein the shaft 11 is completely surrounded by the sealing face 14. The elevation has different heights in radial directions.

Bearing points 15*a*, 15*b*, 15*c*, 15*d* are arranged within the region surrounded by the sealing face 14. The bearing points 15*a*, 15*b*, 15*c*, 15*d* are configured, for example, as cast-on portions on the encapsulating housing 1, in which blindhole-like cutouts are introduced which are provided with threads, with the result that an adaptor plate can be fixed to these bearing points 15*a*, 15*b*, 15*c*, 15*d* by means of threaded bolts, for example.

Figure 3:
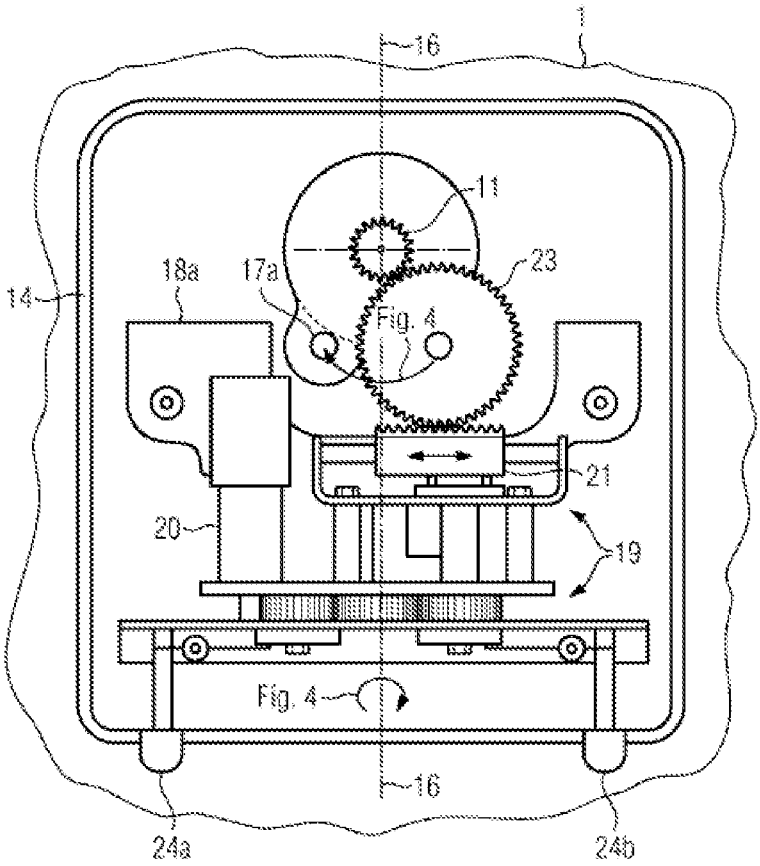
FIG. 3 shows a plan view of an accommodating shaft of an encapsulating housing known from FIGS. 1 and 2 having a gear mechanism in a first installed position.
Figure 4:
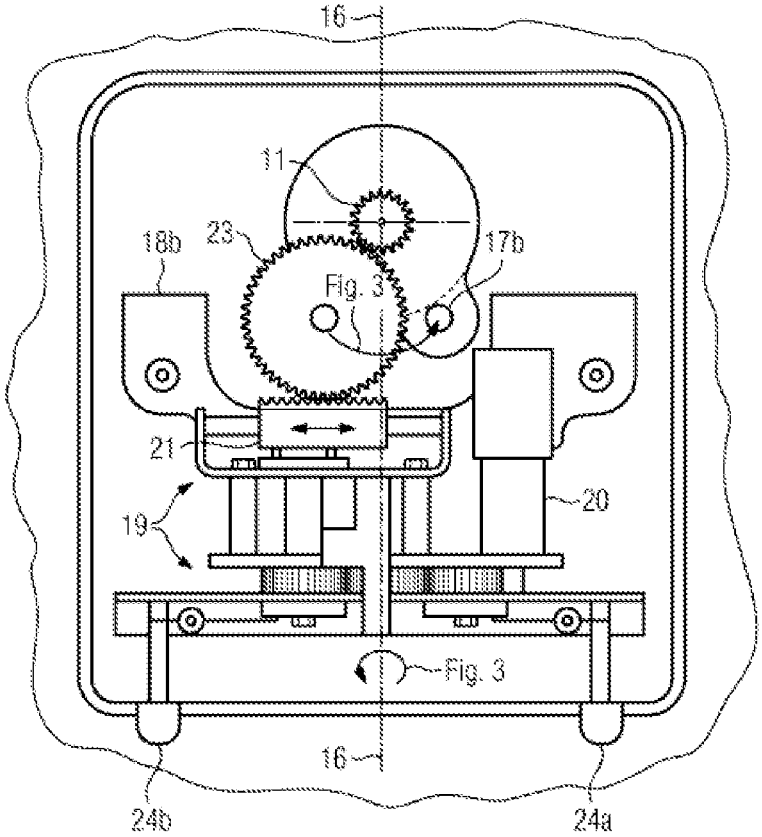
FIG. 4 shows a plan view of the accommodating shaft with the gear mechanism in a second installed position.

A turning axis 16 is arranged in such a way as to be aligned radially with respect to the axis of the shaft 11. The turning axis 16 acts as axis of symmetry which runs through the axis of the shaft 11 at right angles. A first abutment point 17*a* and a second abutment point 17*b* are arranged in mirror-symmetrical fashion with respect to the turning axis 16. An accommodating shaft into which a drive device can be inserted is delimited by the peripheral sealing face 14. FIGS. 3 and 4 now show two installation variants of a drive device in the drive shaft shown in FIG. 2. FIGS. 3 and 4 illustrate a plan view of the axis 11, with the axis of the shaft 11 protruding from the respective plane of the drawing perpendicularly.

A first adaptor plate 18*a* is placed on the bearing points 15*a*, 15*b*, 15*c*, 15*d*. A gear mechanism 19 is attached to the first adaptor plate 18*a*. The gear mechanism 19 can be moved via an electric motor drive 20. The electric motor drive 20 acts, via a large number of toothed gears which step down a rotary movement of the electric motor drive 20, on a shaft which is connected, via journals, to a laterally movable toothed rack 21. The toothed rack 21 is guided in the manner of a carriage on a mount which is held in a bracket 22, which is connected at a fixed angle to a chassis of the gear mechanism 19. The toothed gears of the gear mechanism 19 and the toothed rack 21 are moving parts of the gear mechanism 19. The shaft 11 is provided with a toothed portion, with which a toothed gear 23 mounted on the encapsulating housing 1 independently of the gear mechanism 19 engages. In addition to the toothed gear 23 being coupled to the toothed portion of the shaft 11, the toothed gear 23 is in engagement with the toothed portion of the toothed rack 21, with the result that, in the event of a lateral movement of the toothed rack 21 over the toothed gear 23, the lateral movement is converted into a rotary movement of the shaft 11, i.e. the movable toothed rack 21 provides the output movement of the gear mechanism 19, with this movement being coupled into the shaft 11 indirectly via the toothed gear 23. In a corresponding design configuration, it is also possible to dispense with the use of a toothed gear 23 and for the toothed rack 21 to be coupled directly to the shaft 11.

Switching position indicator devices 24*a*, 24*b* are arranged on both sides of the turning axis 16. The switching position indicator devices 24*a*, 24*b* indicate the switching positions of the movable active conductors 8, 9 outside the encapsulating housing 1. In this case, one of the switching position indicator devices 24*a* is associated with the first active conductor 8 and the other switching position indicator device 24*b* is associated with the second active conductor 9.

The switching position indicator devices 24*a*, 24*b* operate mechanically, with movements being coupled out of the gear mechanism 19 and being transferred to movable indicator elements of the switching position indicator devices 24*a*, 24*b*. Furthermore, the switching position indicator devices 24*a*, 24*b* can be provided with imaging contacts, with the result that an electrical evaluation of information from the switching position indicator devices 24*a*, 24*b* is also possible.

FIG. 4 now shows a gear mechanism 19 which has been rotated about the turning axis 16 through 180°, wherein a second adaptor plate 18*b* is used for positioning the gear mechanism 19, said second adaptor plate being connected to the bearing points 15*a*, 15*b*, 15*c*, 15*d*, and the gear mechanism 19 being coupled to said adaptor plate. Owing to the position of the turning axis 16 radially with respect to the axis of the shaft 11, FIG. 4 now shows that part of the gear mechanism 19 which is remote from the viewer in FIG. 3. Conversely, FIG. 3 shows that part of the gear mechanism which is remote from the viewer in FIG. 4. Owing to the asymmetrical position of the laterally movable toothed rack 21 with respect to the turning axis 16 in the neutral position, the toothed gear 23 has been transferred from abutment point 17*b* to abutment point 17*a*, with the result that central contact of the meshing toothed gear 23 in relation to the lateral extent of the toothed rack 21 is provided now in the neutral position of the gear mechanism 19 and therefore the neutral position of the active conductors 8, 9, as shown in FIG. 1. By virtue of the gear mechanism 19 turning about the turning axis 16, a change in the sense of direction with respect to the first direction and the second direction is provided, which can be picked off at the movable toothed rack 21. It is thus possible to provide a reversal of the sense of direction at the shaft 11 whilst maintaining the same structural design and maintaining the same electrical configuration for the driving of the electric motor drive 20.

The position of the gear mechanism 19 with respect to the turning axis 16 can be reversed repeatedly. By turning the gear mechanism 19 through 180° about the turning axis 16, the sense of direction of the movement output at the shaft 11 is reversed, with the structural design of the gear mechanism being maintained. As a result, a dual design of different gear mechanisms for reversing the direction of rotation is avoided.

A covering hood provided with a mirror-inverted sealing face can be placed onto the sealing face 14, with the result that assemblies such as the transmission 19, the gearwheel 23 etc. which are arranged within the accommodating shaft of the encapsulating housing 1 are protected from external influences.

The invention claimed is:

1. A switching device arrangement, comprising:

an encapsulating housing;

a movably mounted active conductor disposed within said encapsulating housing;

a drive device having a gear mechanism disposed outside said encapsulating housing and coupled into and forming a part of a kinematic chain for moving said active conductor, said kinematic chain passing through said encapsulating housing;

said gear mechanism being coupled into said kinematic chain and selectively disposed in one of two alternative positions wherein said gear mechanism is either disposed in a first orientation or, pivoted about a given turning axis, in a second orientation so as to reverse a direction of a movement with a changed sense of direction of the movement to be output by said gear mechanism.

2. The switching device arrangement according to claim 1, wherein said kinematic chain includes a shaft passing through said encapsulating housing, and said turning axis is aligned radially with respect to said shaft.

3. The switching device arrangement according to claim 1, wherein said encapsulating housing has an accommodating shaft, into which said gear mechanism is inserted, alternatively rotated by 180° about said turning axis.

4. The switching device arrangement according to claim 3, wherein said accommodating shaft is delimited by a peripheral sealing face surrounding said drive device.

5. The switching device arrangement according to claim 3, wherein said accommodating shaft has bearing points, and said gear mechanism is fixed at said bearing points by way of at least one adaptor plate.

6. The switching device arrangement according to claim 3, wherein said accommodating shaft comprises a toothed portion for coupling in the movement of the gear mechanism.

7. The switching device arrangement according to claim 6, wherein said toothed portion is a toothed portion of a spur gear.

8. The switching device arrangement according to claim 6, wherein said gear mechanism has a laterally movable toothed rack in direct meshing engagement with said toothed portion of said shaft.

9. The switching device arrangement according to claim 6, wherein said gear mechanism has a laterally movable toothed rack in indirect engagement with said toothed portion of said shaft.

10. The switching device arrangement according to claim 9, which comprises a toothed gear mounted independently of said gear mechanism and connecting said toothed rack with said shaft.

11. The switching device arrangement according to claim 10, wherein said toothed gear is disposed on said encapsulating housing when the position of said gear mechanism changes in mirror-inverted fashion with respect to said turning axis.

12. The switching device arrangement according to claim 3, which comprises a switching position indicator device arranged on either side of said turning axis and spaced apart from said turning axis.

13. A switching device arrangement, comprising:

an encapsulating housing having a housing wall defining an interior and an exterior of said encapsulating housing;

a plurality of bearing points formed on said housing wall on the exterior of said encapsulating housing;

a movably mounted active conductor disposed in the interior of said encapsulating housing;

a drive shaft for moving said active conductor, said drive shaft projecting through said housing wall and connecting to said active conductor in the interior of said encapsulating housing;

a drive device disposed outside said encapsulating housing, said drive device having a gear mechanism coupled into and forming a part of a kinematic chain for moving said active conductor, said kinematic chain connecting said drive device to said drive shaft, through said encapsulating housing, and to said active conductor;

said gear mechanism being mounted to said bearing points on the exterior of said encapsulating housing in either of two alternative positions wherein said gear mechanism is either disposed in a first orientation or, pivoted about a given turning axis, in a second orientation, said first orientation being different from said second orientation relative to said bearing points.

14. The switching device arrangement according to claim 13, wherein said given turning axis is oriented orthogonally to said drive shaft.

15. The switching device arrangement according to claim 13, wherein said gear mechanism is pivoted about the given turning axis by substantially 180° between the first and second orientations.

16. The switching device arrangement according to claim 3, wherein said gear mechanism is pivoted about the given turning axis by substantially 180° between the first and second orientations.

* * * * *